United States Patent [19]

Lee

[11] 4,147,348

[45] Apr. 3, 1979

[54] TENNIS RACKET PROVIDING INCREASED HITTING POWER

[76] Inventor: J. Kelly Lee, 20 Medallion Dr., Rochester, N.Y. 14626

[21] Appl. No.: 641,632

[22] Filed: Dec. 17, 1975

[51] Int. Cl.[2] ..... A63B 49/08

[52] U.S. Cl. ..... 273/73 C; 273/75

[58] Field of Search ..... 273/29 A, 67 R, 67 B, 273/72 R, 73 R, 73 C, 73 J, 75, 76, 81 R, 81.3, 81.4; 30/355; 124/20; 15/141, 143; 145/61 C; 81/428 PM; D34/5 ST, 5 SP; D7/161, 178, 179, 137

[56] References Cited

U.S. PATENT DOCUMENTS

| | | | |
|---|---|---|---|
| D. 164,883 | 10/1951 | Schmid | D34/5 SP |
| D. 168,192 | 11/1952 | Schmid | D34/5 SP |
| D. 236,793 | 9/1975 | Benktzon | D7/137 |
| 412,479 | 10/1889 | Davis | 273/75 X |
| 595,438 | 12/1897 | Hall | 145/108 R |
| 2,205,769 | 6/1940 | Sweetland | 273/81.4 X |
| 2,421,339 | 5/1947 | Leger | 30/340 X |
| 2,914,785 | 12/1959 | Ela | 15/143 R |
| 3,203,697 | 8/1965 | Berzatzy | 273/75 |
| 3,272,193 | 9/1966 | Olecko | 273/81.4 X |
| 3,326,554 | 6/1967 | Scully | 273/81.3 |
| 3,545,755 | 12/1970 | Owada | 273/73 J |
| 3,554,545 | 1/1971 | Mann | 273/72 R |
| 3,702,701 | 11/1972 | Vaughn et al. | 273/73 J X |
| 3,868,110 | 2/1975 | Jones | 273/75 |
| 3,879,048 | 4/1975 | Penney | 273/75 X |
| 4,038,719 | 8/1977 | Bennett | 273/81.3 X |

FOREIGN PATENT DOCUMENTS

| | | | |
|---|---|---|---|
| 3806 of | 1927 | Australia | 273/81.3 |
| 11615 of | 1928 | Australia | 273/75 |
| 334745 | 9/1955 | Switzerland | 30/355 |
| 5457 of | 1884 | United Kingdom | 273/73 D |
| 229103 | 2/1925 | United Kingdom | 273/75 |
| 1396424 | 6/1975 | United Kingdom | 273/75 |

*Primary Examiner*—Richard J. Apley

*Attorney, Agent, or Firm*—Larson, Taylor & Hinds

[57] ABSTRACT

An improved racket is provided for use in tennis and the like which is believed to enable a user to hit with more power while reducing the torsional forces on the arm. The racket of the invention includes a handle having a bent or offset portion which is of such a shape that the centerline of the racket head is substantially colinear with that of the forearm of the user and thus the racket head is effectively an extension of the arm. When viewed in plan, the throat or shaft of the racket is preferably offset downwardly about 32° relative to the grip or butt portion of the handle while the racket head is preferably offset upwardly about 5° relative to the throat. The racket also includes an improved grip which is fit to the hand of the user.

8 Claims, 3 Drawing Figures

TENNIS RACKET PROVIDING INCREASED HITTING POWER

FIELD OF THE INVENTION

The present invention relates to an improved racket for tennis and the like which is believed to increase the hitting power of the user while theoretically decreasing arm strain.

BACKGROUND OF THE INVENTION

With the recent surge in interest in tennis in the United States a great deal of time and research has gone into perfecting the tennis racket. A large number of different designs and materials have been used in making the racket body, the grip and the strings. In general, these designs are concerned with providing improved power and/or control. However, in substantially all instances, the overall shape of the racket has remained the same.

Before proceeding further, the shape of a conventional racket and the effect of this shape should be considered. Most tennis instructors and books on tennis advise that the racket is to be gripped as though one were shaking hands with the racket. Upon closer examination, the racket is actually gripped or grasped as a club. The club is, of course, an instrument for striking downwardly. However, the tennis ball should be struck, on both forehand and backhand shots, with the body to the side of the ball and thus the motion of the arm is not down on the ball, as to pound the ball into the ground, but is rather more like that of a pendulum turned on its side with the pivot in the center of the body. As is explained hereinbelow, the shape of the racket of the invention is in harmony with this motion and is believed to provide increased striking force both on forehand and backhand shots.

A much publicized problem associated with tennis, particularly when played on a regular basis, is so-called "tennis elbow". This affliction, which is an inflammation of the tendons of the elbow, can be very severe. For example, cases are reported where the pain is such that the arm must be supported during simple activities such as shaving.

Many members of the medical profession have focussed their attention on this general problem from the point of view of treatment. However, some work also has apparently been done in the area of racket design. The work of a Dr. Arthur Bernhang in this regard has been reported in the newspapers (Times Union, Rochester, N.Y., Oct. 13, 1975). The racket designed by Dr. Bernhang includes a grip "not unlike that of a machine gun" and, as reported, has not been a success. The racket of the present invention is believed to combat tennis elbow in addition to providing increased hitting power.

Patented rackets, for tennis and related fields, which bear some similarity to the racket of the invention include those disclosed in U.S. Pat. No. 3,545,755 (Owada); U.S. Patent No. Des. D168,192 (Schmid) and the British Pat. Nos. 5457 (Moss) and 8904 (Owen) although this listing is not, nor is it represented to be, exhaustive. The differences between the racket of the present invention and those disclosed in the patents listed are obvious upon inspection of these patents and hence these patents will not be discussed further.

SUMMARY OF THE INVENTION

In accordance with the invention, an improved tennis racket is provided which, as noted above, is believed to provide improved hitting power for both forehand and backhand strokes while at the same time decreasing the torsional stresses on the arm which can cause "tennis elbow".

The racket of the invention includes an unique handle which is offset or bent in the plane of the racket head in such a manner that the racket head is substantially colinear with the forearm of a user and thus is effectively an extension of the forearm. The amount of offset between the shaft or throat portion of the handle and the grip or butt portion is preferably approximately 32° although an angular offset of within about ±4° of this 32° figure is thought to produce similar results. In the preferred embodiment, the racket head is also offset relative to the shaft or throat by a small angle, such as approximately 5°. Thus, the handle of the invention preferably includes two bends therein, a "downward" bend of the shaft relative to the grip of about 28° to 36° and an "upward" bend of the head relative to the shaft of about 5°.

According to a further aspect of the invention, an improved grip is also provided which more comfortably fits the hand of the user. This grip includes a laterally extending flange located at the butt end of the handle which enables one to swing the racket freely without fear of losing one's hold on the racket. The grip can be fabricated by injecting an epoxy foam into a bladder-like form or mold surrounding the racket handle and having the individual then grip the handle until the foam sets. The grip can also be precast at the factory using a foam or other plastic core and a porous synthetic covering layer. The epoxy grip is rigid as well as lightweight and thus helps keep the overall weight of the racket down.

By providing a racket whose head is effectively an extension of the forearm of the user, the racket can be swung in a more natural manner. As explained in more detail hereinbelow, this apparently increases the amount of striking power that can be generated, for both forehand and backhand strokes, and also gives the user a better idea of the position in space of the racket head, thereby increasing control. Finally, the racket of the invention, in eliminating the rather severe angle between the arm of the user and the racket head associated with conventional rackets decreases the torsional forces acting on the tendons of the arm and thus is thought to combat ailments such as "tennis elbow".

Other features and advantages of the invention will be set forth in, or apparent from, the detailed description of a preferred embodiment found hereinbelow.

DESCRIPTION OF THE PREFERRED EMBODIMENTS

Figure 1:
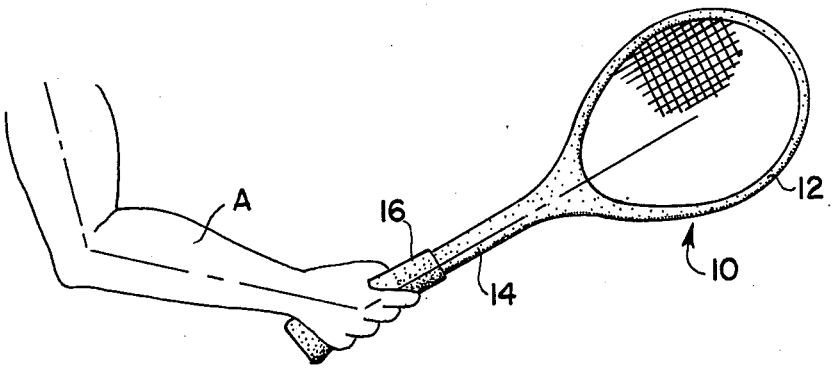
PRIOR ART FIG. 1
FIG. 1 is a plan view of a conventional tennis racket illustrating the manner in which the racket is gripped and showing the angular relationship between the head of the racket and the arm of a user.

Referring to FIG. 1, a conventional racket is shown. The racket, which is denoted 10, includes a head 12, a throat or shaft 14 and a handle or grip 16, all of conventional construction. As illustrated, the centerline of the racket 10, drawn through the center of shaft 14 and the head 12, lies at an angle (very roughly 130°) with respect to the forearm A of a person grasping or gripping the racket.

Figure 2:
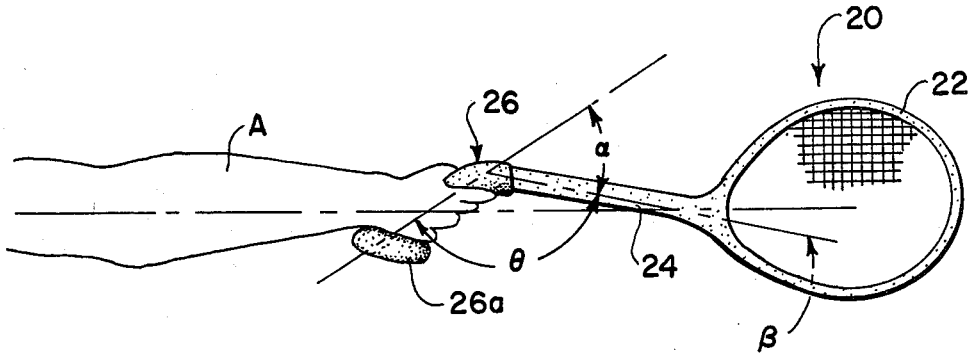
FIG. 2 is a plan view of the racket of the invention illustrating the manner in which the racket is gripped and showing the angular relationship between the racket head and the arm of a user.

Referring now to FIG. 2, the racket of the invention is shown. The racket, which is generally denoted 20, includes a head 22, a throat portion of shaft 24 and a handle portion or grip 26, and the shaft 24 including the grip, is of such a shape that the centerline of the racket head 22 and the centerline of the forearm A of the user, are colinear, that is, from a continuous straight line. With this arrangement the racket head 22 is an extension of the arm of the user. In general, this result is due to the angle formed between the shaft 24 and the grip 26. Thus, referring to FIG. 2, the angle $\alpha$, which represents the amount of offset of the shaft 24 relative to grip 26, is about 32° so that the angle $\theta$ between the grip 26 and the shaft 24 is about 148°. It is believed that the angle $\alpha$ can vary about $\pm 4°$ for a racket whose effective length is approximately that of a conventional racket and still produce generally the same results, depending on the height, arm length and the like of the user.

Because of the rather severe angle between the grip 26 and shaft 24 it is, in general, necessary to offset the head 22 relative to shaft 24, as is illustrated in FIG. 2. The amount of this offset which corresponds to angle $\beta$ in FIG. 2, is approximately 5°

Figure 3:
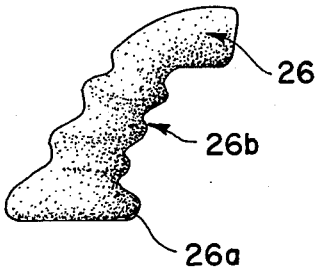
FIG. 3 is a detail of the racket of FIG. 2 showing the racket handle.

FIG. 3 shows, in an enlarged form, the grip 26 shown in FIG. 2. The grip 26 includes a flange or butt **26*a* that provides a comfortable feel for a player and permits the player to swing freely, with full power, without fear of losing his grip on the racket. In accordance with a further important feature thereof, the grip or handle is designed to more comfortably fit the hand of the user. This can be done, for example, by injecting a polyurethane foam or the like into a "bladder" or other flexible form disposed around the racket handle. The individual then holds the racket for the time required for the polyurethane to harden or set (a matter of a few minutes). The result is a racket having a handle which exactly fits the hand as is illustrated by the custom shaping indicated at 16*b* in FIG. 1**. Form fitting grips or handles can also be factory precast with a foam or other plastic core and a porous synthetic overcoating.

The racket of the present invention, being an extension of the player's arm, enables the player to be much more aware of the location of the racket head in space. To explain, most people can touch the tips of their forefingers together with looking, i.e., with their eyes closed or blindfolded. This is because we are aware of the spacial locations of our body extremities even when we cannot see. In a similar manner, because the racket of the invention is an extension of the arm, one has a much keener perception of the location of the racket head in space and, in serving and fast play, this can mean the difference between making a shot and missing it. Further, as noted above, because the racket of the invention enables one to swing in a more natural manner (and the torsional stress and the awkward angles associated with conventional rackets are eliminated), a substantial increase in stroking power results. In particular, because the hand is at a natural comfortable angle relative to the racket and the body can pivot smoothly with the arm extended, it is believed that greater power can be delivered to the ball. In addition, this increase in stroking power is believed to occur for both backhand and forehand shots, and these shots can be effected without the player changing grips as is conventionally required. Further, the reduction of the torsion on the joints produced with conventional rackets is believed to decrease the likelihood of "tennis elbow".

The invention has been discussed hereinbefore relative to a tennis racket. However, the basic principles of the invention are clearly applicable to other sports such as racket ball, badmitton, squash and paddle ball, among others. More generally, it will be understood by those skilled in the art that while the invention has been described relative to exemplary embodiments thereof, variations and modifications can be effected in exemplary embodiments without departing from the scope and spirit of the invention.

I claim:

1. A racket, for use in a game such as tennis or the like, comprising a racket head and a racket handle attached at one end to the racket head and including a throat portion at one end thereof adjacent the head and a gripping portion at the other end for gripping by a user, wherein the improvement comprises a racket handle including an angularly offset portion wherein the axis of the throat portion forms an angle of between about 28° and 36° with the axis of the gripping portion in the plane of the racket so that, in use, the centerline of the head of the racket is substantially colinear with the forearm of a user when gripping the gripping portion of the other end of said handle in a normal handshaking grip, the portion of said throat portion of said racket handle immediately adjacent the said racket head being substantially straight and being offset relative to the racket head in the plane thereof at an angle smaller than the angle between the axis of the throat portion and the axis of the gripping portion.

2. A racket as claimed in claim 1 wherein said throat portion is angularly offset relative to said gripping portion by approximately 32°.

3. A racket as claimed in claim 1 wherein said throat portion is offset relative to the racket head by approximately 5°.

4. A racket as claimed in claim 1 wherein, when viewed in plan with the gripping portion downward, said throat portion is offset downwardly relative to said gripping portions, and the racket head is offset upwardly relative to said throat portion.

5. A racket as claimed in claim 4 wherein the amount of angular offset between said throat and gripping portions is approximately 32° and the amount of angular offset between the racket head and said throat portion is approximately 5°.

6. A racket as claimed in claim 1 wherein the gripping portion of the racket includes a grip which is contoured to fit the hand of the user and which includes a laterally extending flange portion at the free end of the gripping portion.

7. A racket as claimed in claim 6 wherein said grip is fabricated of a plastic foam.

8. A racket as claimed in claim 1 wherein said handle further includes a contoured, plastic foam grip including a butt portion at the free end thereof.

* * * * *